US007891364B2

(12) United States Patent
Williams

(10) Patent No.: US 7,891,364 B2
(45) Date of Patent: Feb. 22, 2011

(54) PASSAGE BRAID GUIDE MEASURING COMB

(76) Inventor: Latasha Williams, 4710 E. 39th, Little Rock, AR (US) 72053

( * ) Notice: Subject to any disclaimer, the term of this patent is extended or adjusted under 35 U.S.C. 154(b) by 453 days.

(21) Appl. No.: 12/077,356

(22) Filed: Mar. 19, 2008

(65) Prior Publication Data

US 2008/0230083 A1 Sep. 25, 2008

Related U.S. Application Data

(60) Provisional application No. 60/918,992, filed on Mar. 20, 2007.

(51) Int. Cl.
*A45D 7/02* (2006.01)
*A45D 24/00* (2006.01)
*A45D 24/36* (2006.01)

(52) U.S. Cl. ..... 132/212; 132/219; 132/214

(58) Field of Classification Search ..... 132/200, 132/219, 124, 144, 145, 212, 214; D28/25–30, D28/7
See application file for complete search history.

(56) References Cited

U.S. PATENT DOCUMENTS

| | | | | |
|---|---|---|---|---|
| 565,389 | A | 8/1896 | Noyes | |
| 1,369,275 | A | 2/1921 | Noyes | |
| 1,671,094 | A | 5/1928 | Widdows | |
| D162,749 | S | 4/1951 | Polimeni | |
| 2,609,822 | A | 9/1952 | McCormack | |
| 2,661,007 | A | 12/1953 | Bauer | |
| 2,930,385 | A | 3/1960 | Fees | |
| 3,324,865 | A | 6/1967 | Battaglia | |
| 3,444,866 | A | 5/1969 | Battaglia | |
| 3,696,823 | A | 10/1972 | Dannat | |
| 4,108,186 | A * | 8/1978 | Esposto | 132/124 |
| D311,069 | S | 10/1990 | Furco | |
| 5,231,999 | A * | 8/1993 | Schroettner | 132/137 |
| 5,240,017 | A | 8/1993 | Terwilliger | |
| 5,454,385 | A | 10/1995 | George | |
| D364,939 | S | 12/1995 | Scott | |
| D367,129 | S | 2/1996 | de Paris | |
| 5,558,104 | A | 9/1996 | Clouser | |
| 5,626,153 | A | 5/1997 | Petrarca | |
| 5,704,376 | A | 1/1998 | Ogunro | |
| 5,921,252 | A | 7/1999 | Chubb | |
| 5,937,868 | A | 8/1999 | Ogunro | |
| 6,253,771 | B1 * | 7/2001 | McClaine | 132/200 |
| D468,863 | S | 1/2003 | Irving | |
| 6,523,547 | B1 | 2/2003 | Crocilla | |
| 6,615,844 | B2 * | 9/2003 | McClaine | 132/200 |
| 7,073,516 | B1 | 7/2006 | Beamen | |

* cited by examiner

*Primary Examiner*—Robyn Doan

(57) ABSTRACT

A hair styling comb comprising a body having a handle, a release cone, and a guide measuring system that are combined to precisely separate hair in orderly rows for braiding. The guide measuring system facilitates successive measurement of a partial circumference of spaced apart sections of the scalp. Each section is radially measured by successive placement of the comb measuring section upon the scalp, followed by linear movements of the comb until a peripheral measurement is approximated by the combined readings. The spaced apart circumference regions are reduced to increments by dividing their length measurements by the number of desired braid rows the stylist is creating. The release cone is placed in the grooves of the bottom of the braid and ten slid through smoothly upwardly to the scalp of the nape line. The release cone releases the grips of the braids.

2 Claims, 12 Drawing Sheets

PASSAGE BRAID GUIDE MEASURING COMB

CROSS-REFERENCE TO RELATED APPLICATION

This application claims priority based upon a prior U.S. Provisional patent application, Ser. No. 60,918,992, Filed Mar. 20, 2007, and entitled "Passage Braid Guide Measuring Comb," which is hereby incorporated by reference.

BACKGROUND OF THE INVENTION

1. Field of the Invention

The present invention relates generally to combs for styling hair. More particularly, the present invention relates a comb for precisely positioning "corn rows" or sections of hair about the perimeter of the scalp during styling.

2. Description of the Related Art

Combs have long been recognized as important tools for styling hair. So-called "corn rows" are an increasingly popular form of hair styling, particularly amongst African American youth. When parting the hair in the form of popular "corn rows" and braids, attention to detail is required for an accurate and neatly aligned presentation. In other words, the rows must be accurately aligned and arrayed, and then they must be accurately placed. Skilful measurements are needed for proper placement of the rows and braids for attractive work. Many measurements must be made while the styling process continues through various stages.

There are different forms of prior art combs for that include forms of measuring guides, but no known art solves the problems of corn row styling. It is important to enable the stylist to control and manipulate the hair, while at the same time allowing certain measurements to be made to accurately determine where the main rows shall be formed. It is also important that a single tool enables preexisting braids to be disassembled during the styling process.

Thus it is important to provide a single comb that allows the manipulation and parting of hair, while facilitating row placement and braid formation.

BRIEF SUMMARY OF THE INVENTION

I have provided a unique comb for stylists, which enables accurate measurements of the scalp for proper row and braid placement, and a process for styling hair using the comb.

The preferred comb has a mathematical measuring system for measuring the hair around the scalp. In addition, parts of the comb enable the parting, taking down the hair, grooming, analysis of the scalp, and arrangement of the hair. The guide measuring system allows one to separate or section hair while keeping the parts and measurements straight throughout the design. The preferred comb enables the stylist to quickly adapt to the shape and size of a client's scalp, and to properly "lay out" the desired number of rows. The comb is a combination of multiple tools dealing with measuring, grooming and treatment of the hair and its appearance. The grip handle is connected to numerous teeth combined to insure proper grooming.

A special release cone associated with the body of the comb has an indent in the connecting base for parting the hair. The grip handle positions the hand in a firm hold for a smoother flow of the comb for a precise firm grip for combing and separation of the hair. The structural arrangement ensures less breakage when separating and collecting portions of the hair for braiding.

An integral guide measuring system is numbered in increments of between zero and twenty-five, over a three inch segment of the comb, which allows measurements. Four or more sections of the scalp periphery will be measured. Starting at the scalp front, for example, the comb is gently pressed against the scalp to measure a first increment of twenty-five units, and then moved for a second and successive measurements of twenty-five units. The last measurement will be less than twenty-five. The successive measurements are totaled, and then the number of desired corn rows is divided into the aggregate measurement to obtain estimated row spacing over that segment of the scalp.

Typically, the comb will be moved about the scalp periphery and three to five measurement of successive scalp regions will follow. As the shape of the scalp varies from front to back, for example, the linear spacing between parallel rows must be determined and observed to align the rows and braids in an orderly, regular array.

The invention provides a new and improved way to accommodate the whole perimeter of a client scalp for an accurate overall style.

My hair comb not only allows one to take down the braid it also helps to achieve a neat and evenly part and achieves evenly measured sections which make a desired style accurate. The release cone at the end of the comb is used in conjunction with the guide measuring system to establish an accurate grid over the scalp for attractive braids and rows.

The preferred release cone allows one to take down the hair with less breakage. The release cone allows you to achieve straight lines. The handle ensures precise comb movement that is less stressful upon the stylist's tendons.

The comb can be flexible in any form in different styles and exercises in any size for further use. The comb can be made from plastic, rubber, aluminum, metal, or any product in the further.

Thus an object is to cut down the process of parting the hair to get an accurate style.

Another object is to provide a measuring comb that enables one to braid or style hair and keep the parts and sections even.

A related object is to facilitate the quick measuring and taking down of the hair.

It is also an object to provide a comb of the character described that enables a stylist to part the hair evenly and provide more accurate rows.

Another important objective is to exercise more of the use of the muscles and the tendons in the hand and arm.

A further object is to provide a comb of the character described that enables more hand motion and flexibility than standard combs.

A still further objective is to provide an attachment for an even better usage in the future.

These and other objectives and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
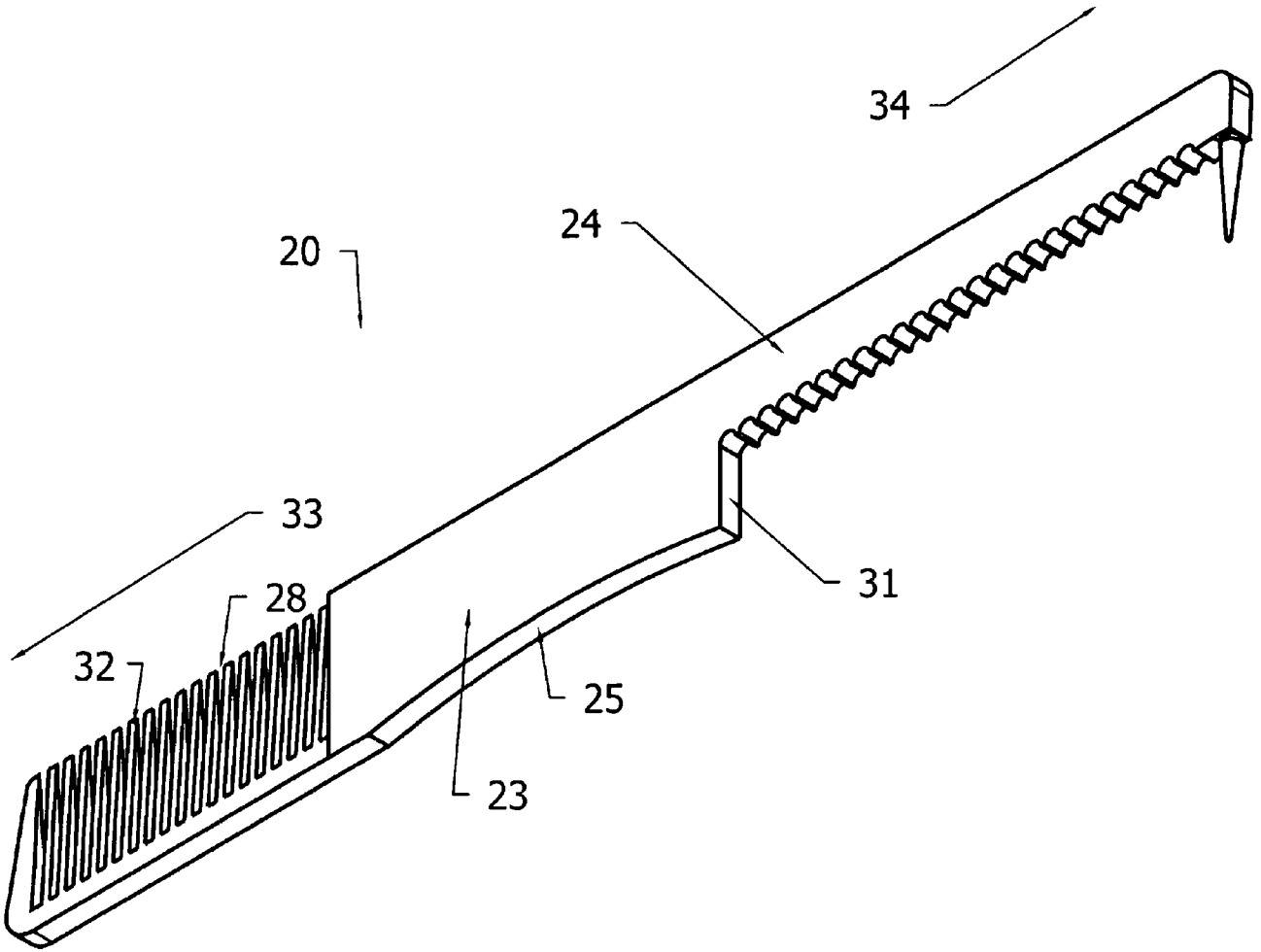
FIG. 1 is an elevational view of my new comb.
Figure 2:
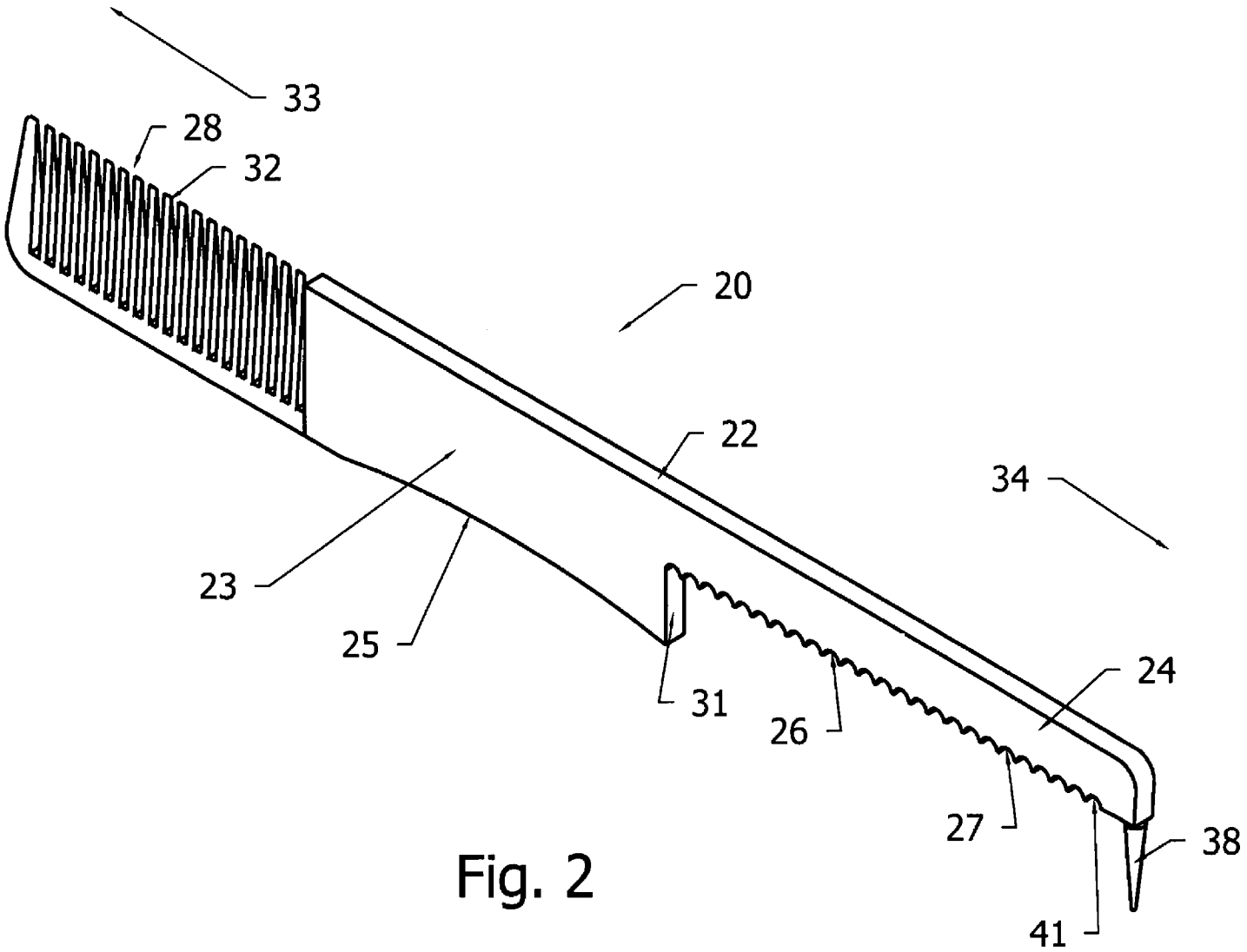
FIG. 2 is an isometric view of my new comb.
Figure 3:
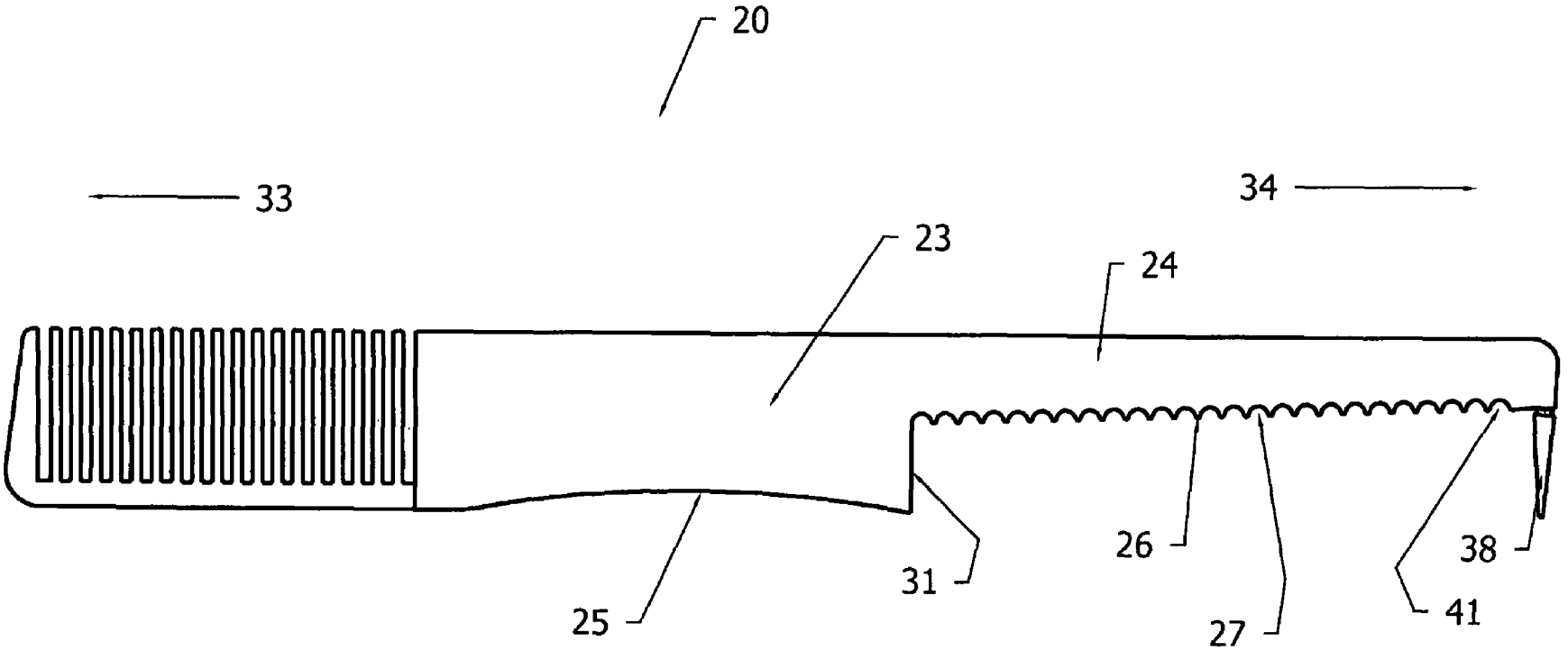
FIG. 3 is a side view of my new comb.
Figure 4:
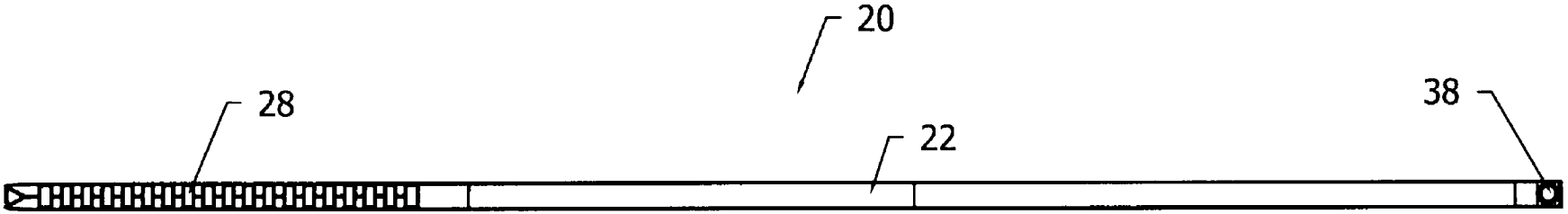
FIG. 4 is a top plan view of my new comb.

With initial reference directed to FIGS. 1-10 of the appended drawings, a comb constructed generally in accordance with the best mode of the invention has been generally designated by the reference numeral 20. The invention provides a new and faster way for disassembling or "taking down" braids or pigtails. When first meeting a customer the comb can be used to determine the customer's preferred braid style or hair style, and length and parting dimensions can be determined. Once a client's preferences and expectations are discerned during the initial consultation, styling can progress and braids and rows can be implemented in an orderly fashion.

In the best mode the comb has several parts. An elongated body 22 has a handle portion 23 integral with a rear measuring portion 24. The preferred length of the measuring section is approximately three inches. The width of the rear measuring portion is substantially less than the width of the handle portion. The front of the comb is broadly designated as 33, and the rear is broadly designated by the reference numeral 34. There is an arcuate depression 25 formed in one side of the handle portion to aid in holding the comb. The measuring portion has a plurality of spaced apart serrations 26 that include spaced apart points 27 that are numbered from 1 to 25 wherein the serrations extending downwardly in a direction opposite from the direction of teeth 32. The toothed cluster section 28 is integral with the body. There a plurality of conventionally spaced-apart teeth 32 arranged in an orderly row wherein the spaced apart teeth 32 extending transversely relative to said body and pointing in a first direction.

The release cone 38 forms an end of the measuring portion 24, which extends to a shoulder 31 at the inner end of the handle section. The release cone projects downwardly in a direction opposite from the direction of the teeth 32. There is an inner styling groove 41 shaped like a notch beneath the release cone 38 at the rearmost end of the measuring system 24.

The release cone 38 is used to release braids that the customer may already have when arriving at the salon. Typical braids have three twisted strands of hair, each comprising several individual hairs. These strands are wound about each other to form a braid. In order to untangle or disassociate a braid, the cone 38 is inserted within a braid, and the comb is gently moved longitudinally with respect to the braid to loosen its strands and separate and unwind them. In other words, hairs are separated from the preexisting braid. The release cone slides within the grooves between braid strands to unwind them, which results in less breakage or hair damage than conventional combing.

Styling Process

Figure 5:
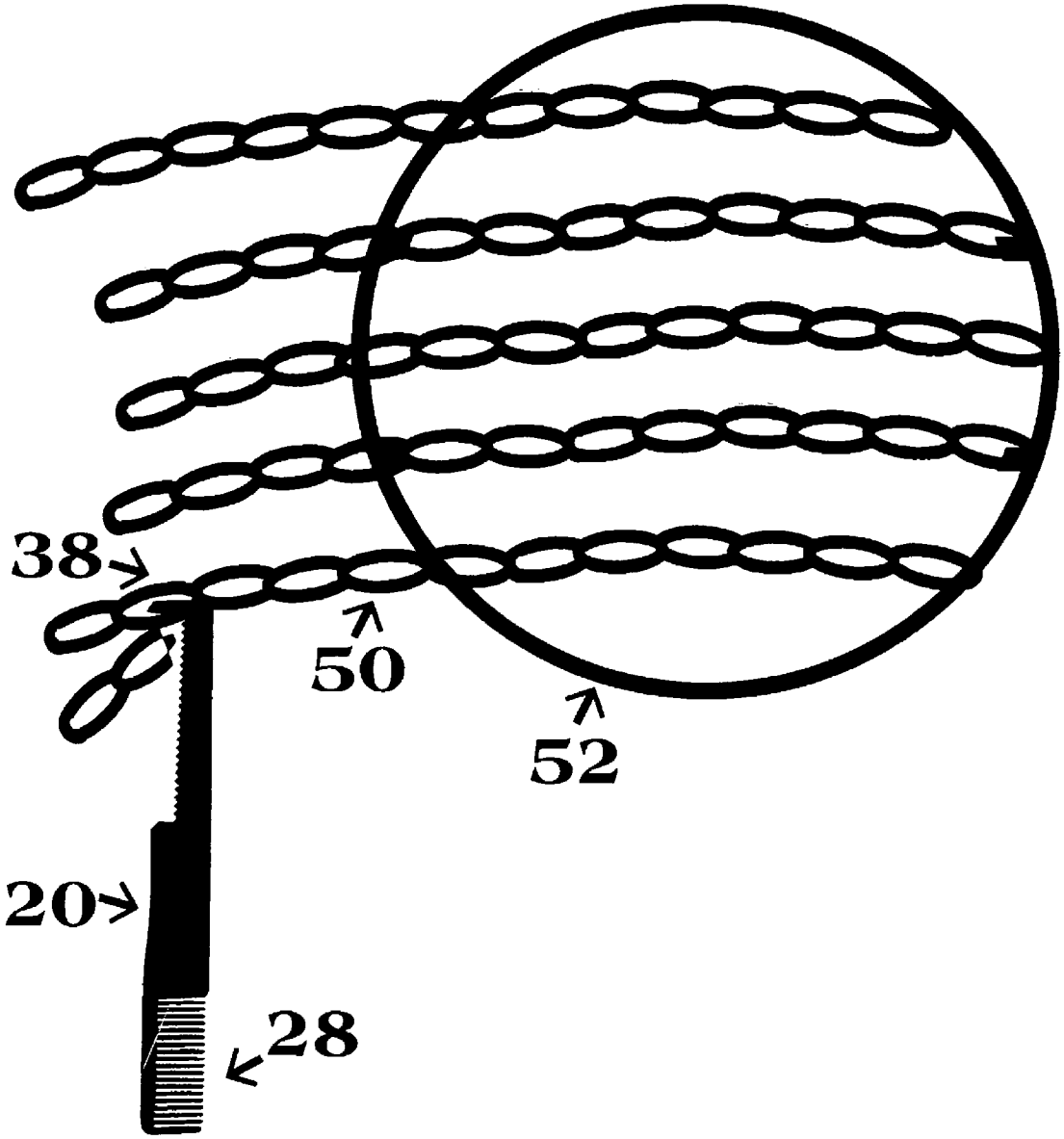
FIG. 5 is a diagrammatic view showing the comb in use at the beginning of styling to "take down" preexisting braids.

Referring to FIG. 5, preexisting braids on a customers head have been designated by the reference numeral 50. These must be unassembled or "taken down" prior to shampooing and the completion of the styling process. The release cone 38 is for the release and relaxation and parting of the hair. The release cone penetrates the old braid between the grooves of the bottom of the braid and slides through smoothly upwardly to the scalp. Once the process is followed through repeatedly to unassembled all braids 50, and the hair is down, the comb tooth section 28 can be used to untangle the hair to prepare for the shampooing of the scalp and hair.

After shampooing, drying proceeds. The hair may be combed until it is tangle free for subsequent styling. At this point, the customers preferences will be known, and the number of desired braids and style will be known. The measuring portion 24 is now used to determine braid alignment and placement.

Figure 6:
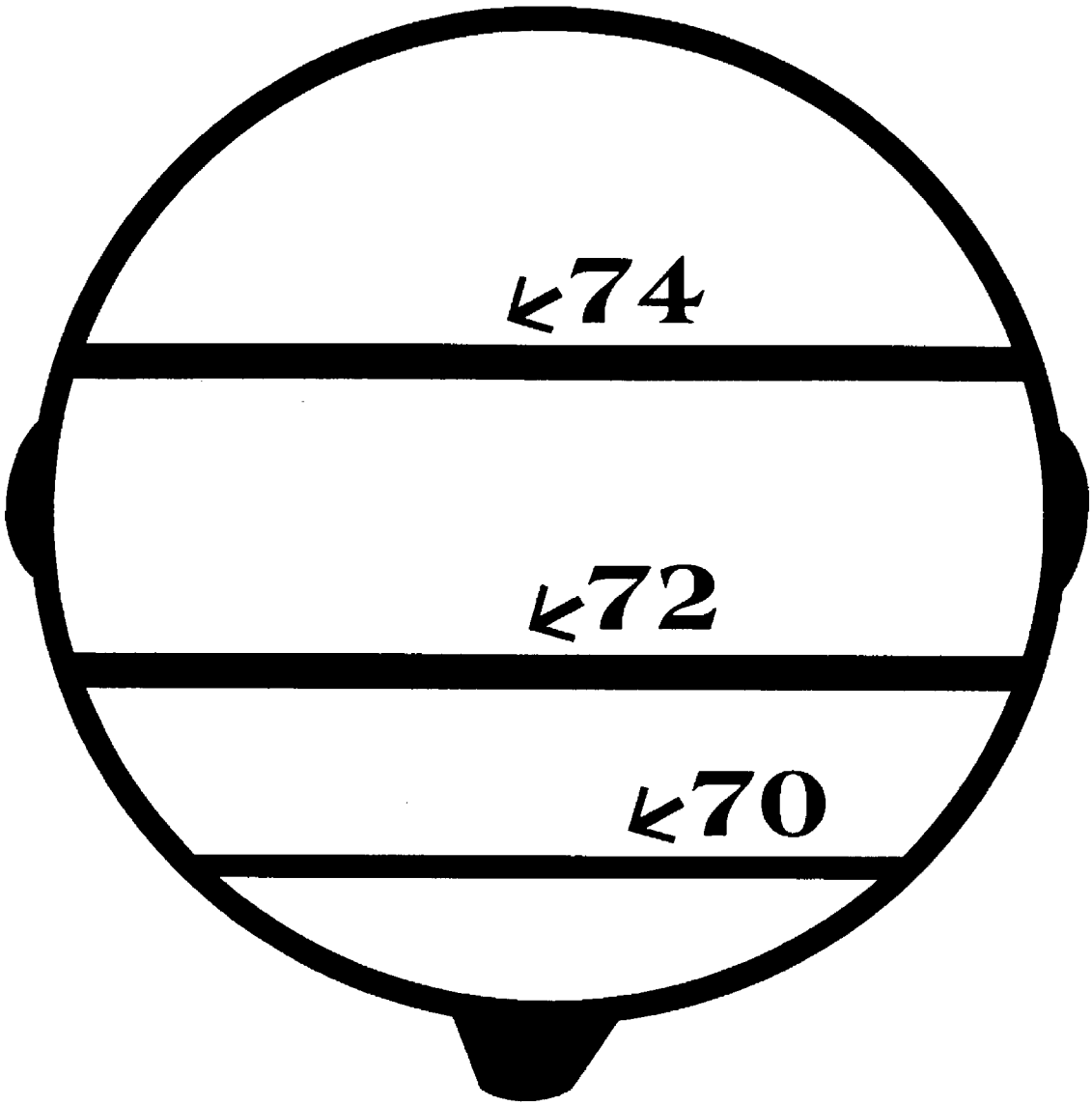
FIG. 6 is a diagrammatic top view of the head of a customer, generally showing guide lines to be measured by the comb for subsequent braiding of the hair.
Figure 7:
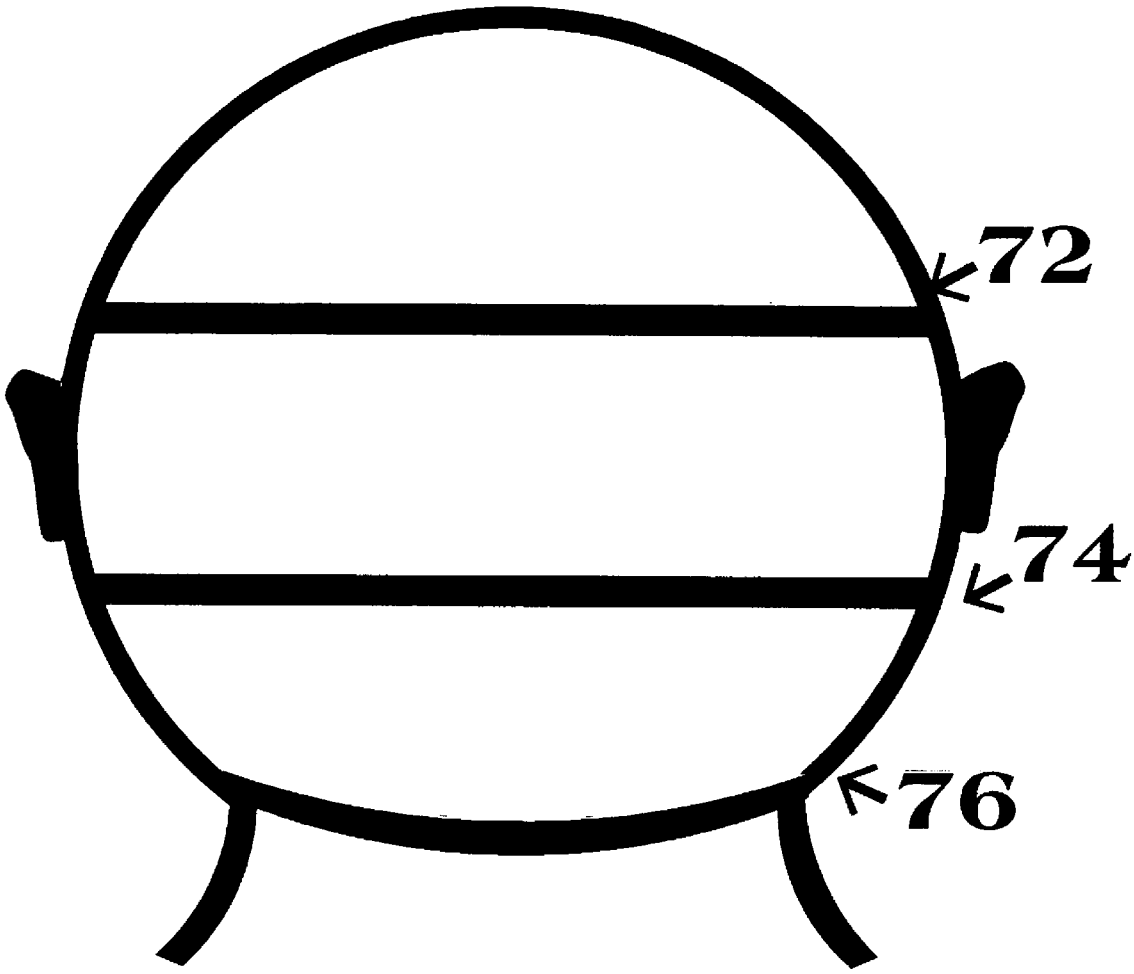
FIG. 7 is a diagrammatic view showing the rear hair lines.

Referring to FIGS. 6 and 7, the customers' head is visualized by the stylist with a plurality of guide lines that will be measured for aligning the braids. The front hair line in FIG. 6 has been designated by the reference numeral 70. The crown hair line 72 is seen in both FIGS. 6 and 7. There is also a back hair line 74, and 76 (FIG. 7 (designates the nape hair line. In practice four such hair lines are preferred.

Each of the reference hair lines 70, 72, 74 and 76 is measured and divided with the comb. This provides reference points where subsequent braids will align on the scalp in an orderly fashion. The braids will extend generally perpendicularly to these visualization hair lines. Since each hair line is measured and divided in a similar fashion, the measurement process is described once.

Figure 8:
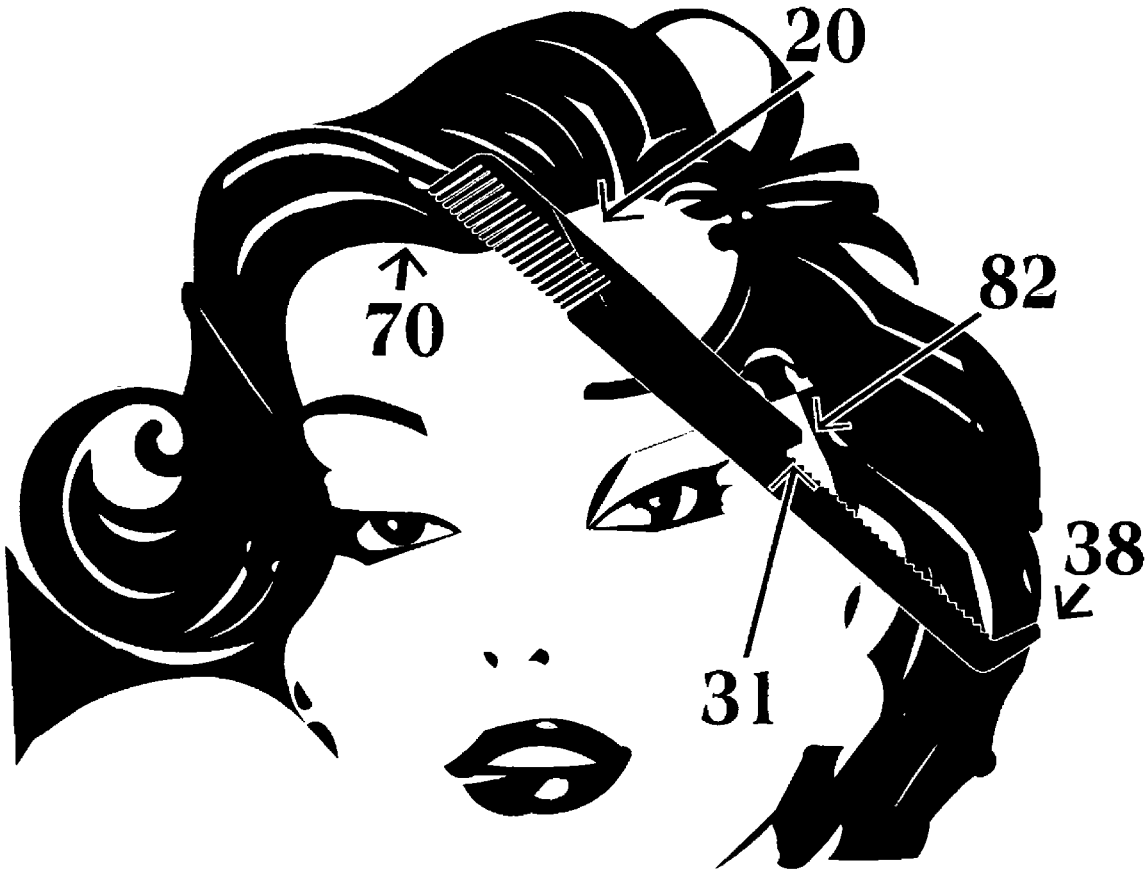
FIGS. 8-11 are sequential views showing measurement of one of the hair lines of FIGS. 6 and 7 for aligning braids to be subsequently formed; and, FIG. 12 is a pictorial view of a customer with completed braids.

In FIG. 8 a first measurement is achieved on the front hair line 70. The stylist places the release cone 38 on the perimeter of the scalp on the front hair line on a lowest side to start the first measurement. When the comb 20 is placed as in FIG. 8 a first reference point 82 is visualized generally proximate the comb shoulder 31, and the cone 38 is moved to that point. A second reference point 84 (FIG. 9) is visualized at the next location of the comb shoulder, as the comb aligns along line 70. A third point 86 results from the third measurement, as in FIG. 10. As the measuring system is calibrated with 25 increments, the totaled measurement so far is 75 increments. However, the last measurement, illustrated in FIG. 11, results in a visualized point 88, that involves less than all 25 reference points in the measuring system. Noting distance 91, seen in FIG. 11, the last measured segment of hair line 70 corresponding to distance 91 measures approximately 13 on the provided scale of 25. The sum of the four measurements just described along hair line 70 is thus 25+25+25+13, or a total of 88. This amount can vary depending upon numerous physical parameters and in relation to the number of braids desired. It four braids are to be established, then they will be separated by 22 points of the measurement system (i.e., 88 divided by 4). These four points, shifted slightly from points 82, 84, 86 and 88 described previously, align the braids in this section of the head, i.e., along front hair line 70.

Figure 9:
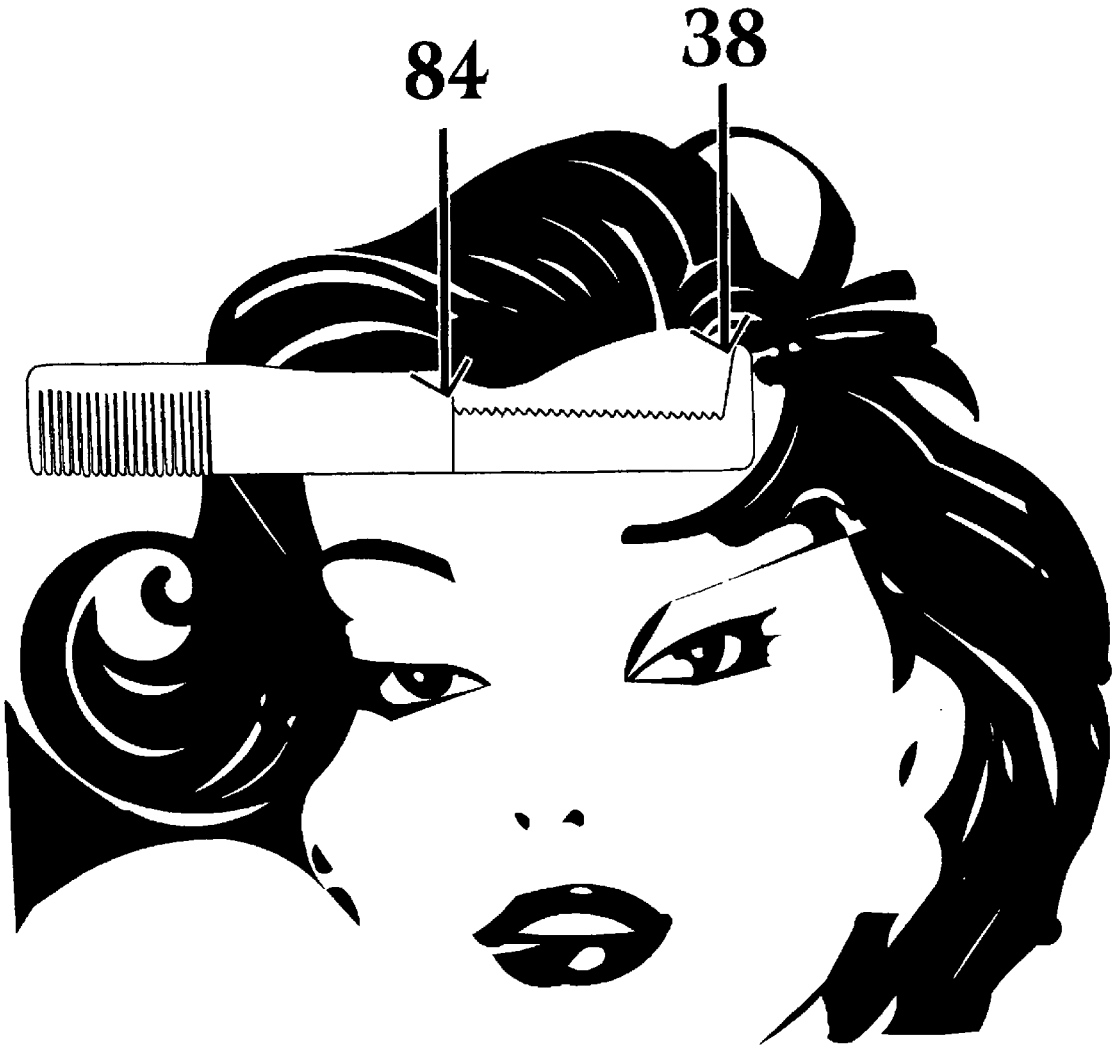
Figure 10:
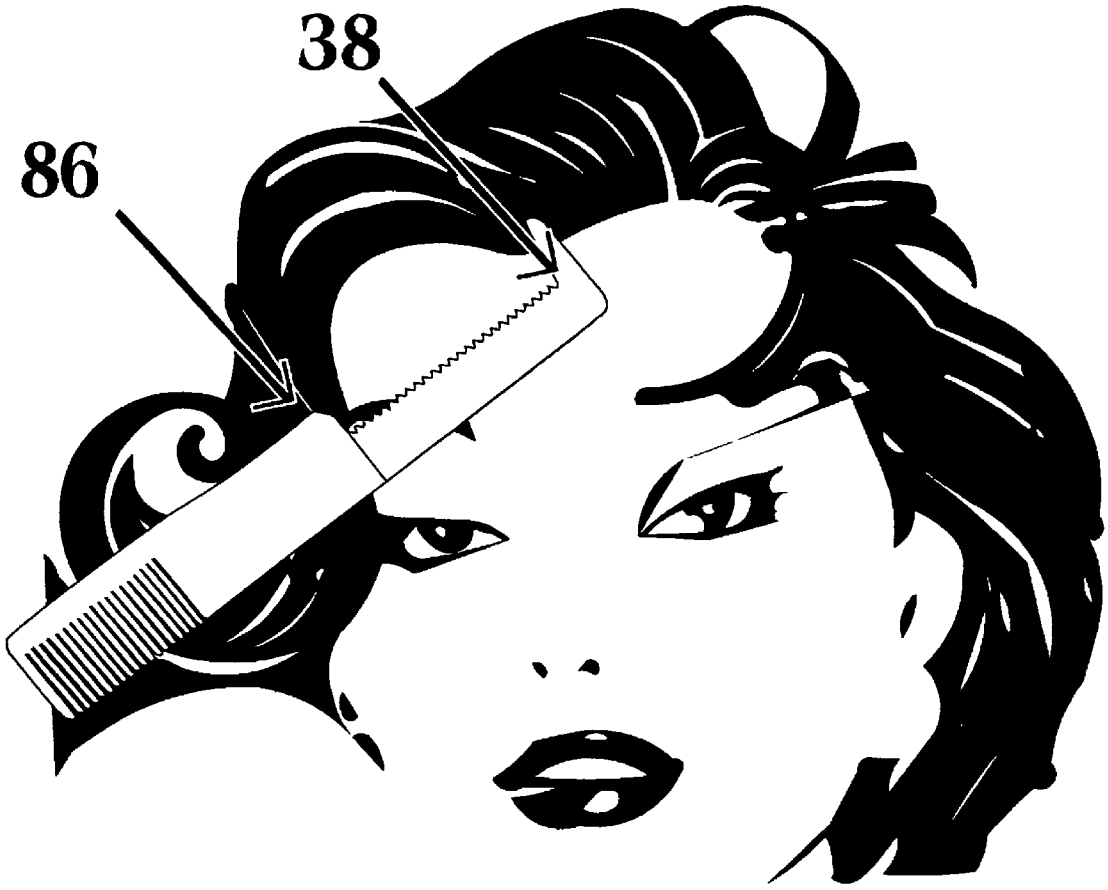
Figure 11:
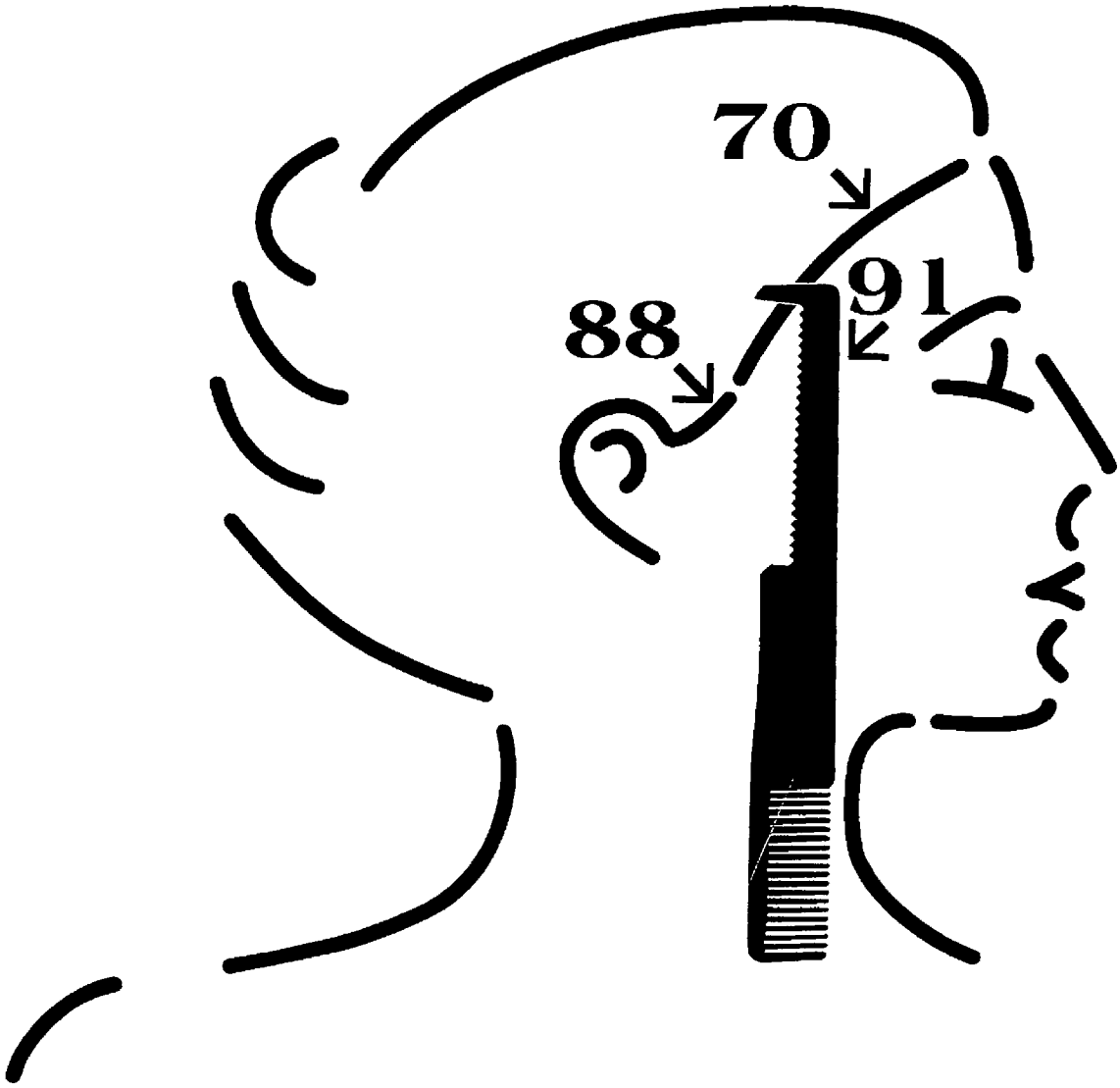
Figure 12:
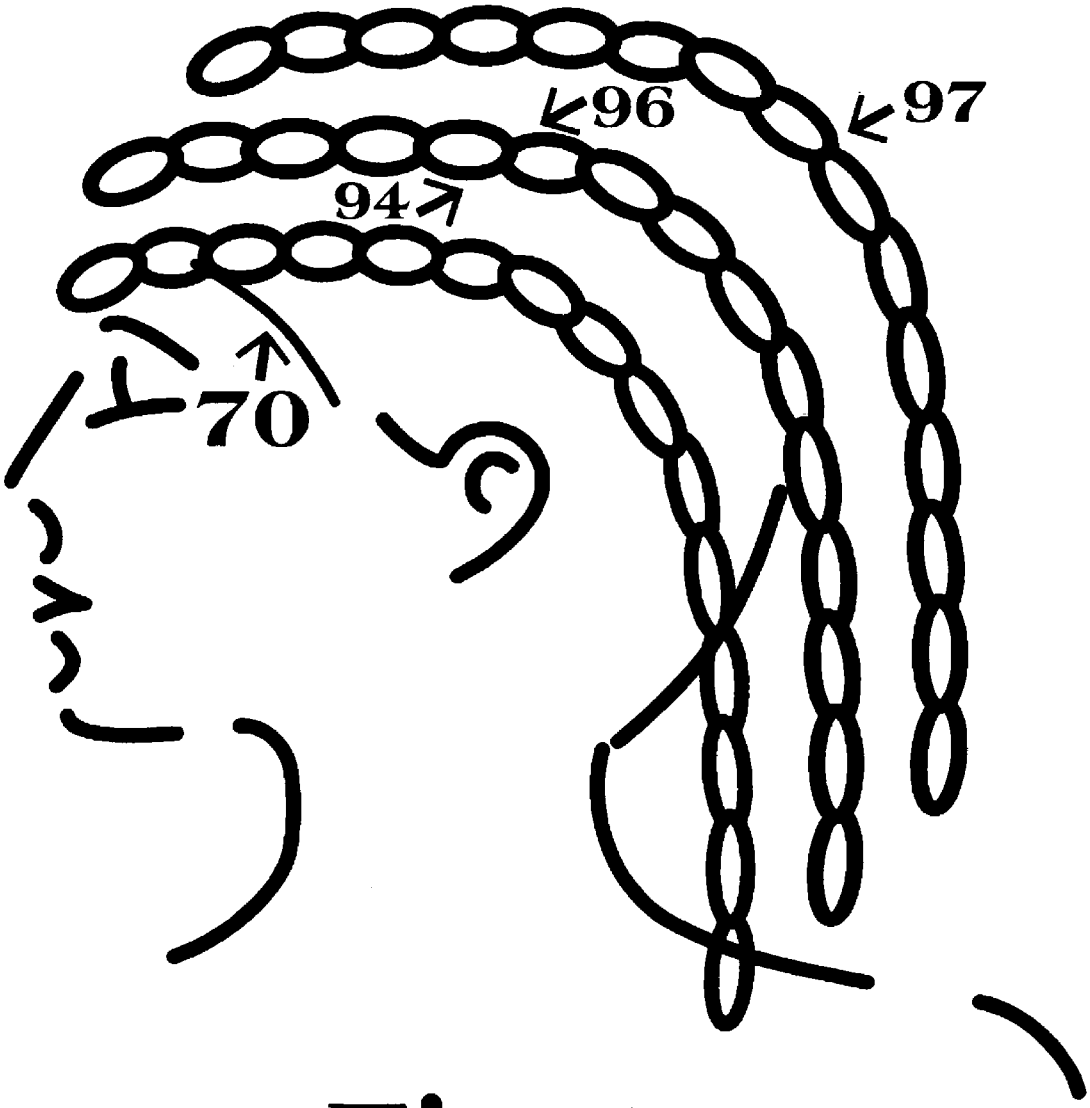

The process just described with FIGS. 8-10 along hair line 70 is repeated in the same manner along hair lines 72, 74 and 76 (FIGS. 6 and 7.) Thus orderly dividing points will be established along these hair lines too. Braids can then be oriented generally perpendicularly relative to the hair lines at the evenly divided reference points visualized by the measuring process described. A grid-like pattern that is properly oriented and centered on the scalp results. Referring to FIG. 12, a typical braid 94 thus runs from an evenly positioned reference point on hair line 70 to the similarly established dividing lines on successive hair lines described above. As a result, each braid 94 is substantially aligned and is generally parallel with successive braids 96, 97.

The specification of the braid style/hair style such as weight, length, fullness can be determined and the client's preferences and expectations can be learned during the initial consultation.

From the foregoing, it will be seen that this invention is one well adapted to obtain all the ends and objects herein set forth, together with other advantages which are inherent to the structure.

It will be understood that certain features and sub-combinations are of utility and may be employed without reference to other features and sub-combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A hair styling comb comprising:

an elongated body having a front and rear, the body comprising a grip handle for grasping by the stylist, said grip handle terminating in a shoulder and having an arcuate depression formed in one side of said grip handle;

a plurality of spaced-apart teeth adjacent said grip handle at the body front for contacting and grooming the hair, the teeth extending transversely relative to said body and pointing in a first direction;

a release cone for separating and parting hair braids, the release cone formed at the body rear;

a guide measuring system disposed between said grip handle shoulder and said release cone, said guide measuring system comprising a plurality of spaced apart, calibrated serrations for measuring hair lines, the serrations extending downwardly in a second direction opposite from said first direction;

a notched styling groove for styling disposed between said guide measuring system and said release cone;

wherein the width of said guide measuring system is less than the width of said handle portion; and, wherein said release cone points away from said guide measuring system in said second direction.

2. A method of styling hair with braids, the method comprising the steps of:

A) providing a comb with a grip handle, a shoulder proximate the grip handle, a plurality of spaced-apart teeth adjacent said grip handle at the body front for contacting and grooming the hair, a release cone for separating and parting hair braids, and a guide measuring system disposed between said grip handle shoulder and said release cone;

B) disassembling previously existing braids with said release cone;

C) shampooing and combing the hair;

D) establishing a plurality of spaced apart reference hair lines between the front of the head and the nape;

E) making a plurality of measurements along a front hair line with said guide measuring system and adding them together;

F) dividing the sum of the measurements in said last step by the number of braids desired to determine braid width;

G) visualizing the desired braid width obtained in Step "F" by establishing braid locations with said comb along said front hair line to provide the alignment points for the braids;

H) repeating said steps E-G for the succeeding reference hair lines to provide points for aligning the braids; and, I) forming the braids along the reference points determined.

* * * * *